US009202620B2

(12) United States Patent
Arimitsu et al.

(10) Patent No.: US 9,202,620 B2
(45) Date of Patent: Dec. 1, 2015

(54) COIL COMPONENT

(71) Applicants: TDK CORPORATION, Tokyo (JP); EPCOS AG, Munich (DE)

(72) Inventors: Kazunori Arimitsu, Tokyo (JP); Hiroshi Suzuki, Tokyo (JP); Yuma Komaya, Tokyo (JP); Hideki Sasaki, Tokyo (JP); Tomonao Suto, Tokyo (JP); Joern Schliewe, Steinheim (DE); Joachim Nassal, Heidenheim (DE); Anneliese Drespling, Heidenheim (DE)

(73) Assignees: TDK CORPORATION, Tokyo (JP); EPCOSAG, Munich (DE)

( * ) Notice: Subject to any disclaimer, the term of this patent is extended or adjusted under 35 U.S.C. 154(b) by 0 days.

(21) Appl. No.: 14/444,304

(22) Filed: Jul. 28, 2014

(65) Prior Publication Data

US 2015/0042436 A1 Feb. 12, 2015

(30) Foreign Application Priority Data

Aug. 8, 2013 (JP) ..... 2013-165039

(51) Int. Cl.
*H01F 27/29* (2006.01)
*H01F 27/02* (2006.01)
*H01F 17/04* (2006.01)

(52) U.S. Cl.
CPC ..... *H01F 27/29* (2013.01); *H01F 17/045* (2013.01); *H01F 27/292* (2013.01)

(58) Field of Classification Search
CPC ..... H01F 17/04; H01F 17/045; H01F 27/29; H01F 27/292; H01F 5/04
USPC ..... 336/83, 192
See application file for complete search history.

(56) References Cited

U.S. PATENT DOCUMENTS

2004/0155745 A1* 8/2004 Wang ..... 336/83
2006/0267719 A1* 11/2006 Yasuda et al. ..... 336/223
2008/0003864 A1* 1/2008 Hatakeyama et al. ..... 439/399

FOREIGN PATENT DOCUMENTS

JP A-2006-4979 1/2006
JP 2012-089804 A * 5/2012
JP A-2012-89804 5/2012

* cited by examiner

*Primary Examiner* — Mangtin Lian
(74) *Attorney, Agent, or Firm* — Oliff PLC

(57) ABSTRACT

In a coil component, a shortest distance from a longitudinal wall of a flange portion of a drum core to a wire fixing portion is smaller than a shortest distance of the longitudinal wall to an electrode wire connecting portion by a convex portion formed at the longitudinal wall of the flange portion. That is, since a gap between the flange portion of the drum core and the wire fixing portion is small (or there is no gap), the wire fixing portion can be sufficiently bent. Accordingly, the wire can be securely fixed by a wire fixing portion of a metal terminal.

4 Claims, 8 Drawing Sheets

COIL COMPONENT

BACKGROUND OF THE INVENTION

1. Field of the Invention

The present invention relates to a coil component.

2. Related Background Art

In the related art, a coil component configured by winding a wire (a conducting wire) on a drum core is known. The drum core has a core portion and flange portions formed at both ends thereof. The wire, which is a copper wire coated with insulation, is wound on the core portion. A plurality of metal terminals are installed at the flange portions, and an end portion of the wire is electrically connected to each of the metal terminals to form wire connections. Such a coil component is disclosed in, for example, Japanese Unexamined Patent Application, First Publication No. 2012-89804 (Patent Literature 1). A metal terminal of Patent Literature 1 has a wire connecting portion configured to connect a wire by welding, and a wire fixing portion configured to hold and fix the wire when the wire is connected.

SUMMARY OF THE INVENTION

In the coil component having the above-mentioned shape, while the wire is fixed to the metal terminal by bending the wire fixing portion in a state in which the wire is held, when a gap is provided between the wire fixing portion and the portion of the drum core corresponding to the wire fixing portion, it is difficult to sufficiently bend the wire fixing portion. Here, through diligent research, the inventor(s) has (have) found a novel technology by which the wire fixing portion can be sufficiently bent and the wire can be fixed by the wire fixing portion more securely.

In an embodiment of the present invention, there is provided a coil component capable of more securely fixing a wire to a metal terminal.

A coil component according to an aspect of the present invention includes a drum core having a pair of flange portions having a mounting surface enabling to face to a mounting substrate and side surfaces crossing the mounting surface, and a core portion configured to connect the pair of flange portions to each other; a wire wound on the core portion of the drum core; and a metal terminal having a mounting portion disposed at the mounting surface of the flange portion, a wire fixing portion extending from the mounting portion and configured to fix the wire, and a wire connecting portion welded to an end of the wire, wherein a shortest distance from the side surface of the flange portion to the wire fixing portion is smaller than a shortest distance from the side surface of the flange portion to the wire connecting portion.

In the coil component, since the shortest distance from the side surface of the flange portion of the drum core to the wire connecting portion is smaller than the shortest distance from the side surface to the wire fixing portion and the gap between the flange portion of the drum core and the wire fixing portion is small (or there is no gap), the wire fixing portion can be sufficient bent. Accordingly, the wire can be more securely fixed by the wire fixing portion of the metal terminal.

In addition, a convex portion may be formed at a surface region corresponding to the wire fixing portion of the side surface of the flange portion. In this case, the distance from the side surfaces of the flange portion to the wire fixing portion is reduced by the convex portion formed at the side surface of the flange portion.

In addition, the convex portion may be inclined such that a width of the convex increases away from the mounting surface. In this case, the gap between the side surface of the flange portion of the drum core and the wire fixing portion reduces away from the mounting surface. In many cases, since the bending of the wire fixing portion is performed at a position spaced apart from the mounting surface, the wire can be more securely fixed in this case.

According to the aspect of the present invention, there is provided the coil component capable of more securely fixing the wire at the metal terminal.

DESCRIPTION OF THE PREFERRED EMBODIMENTS

Figure 1:
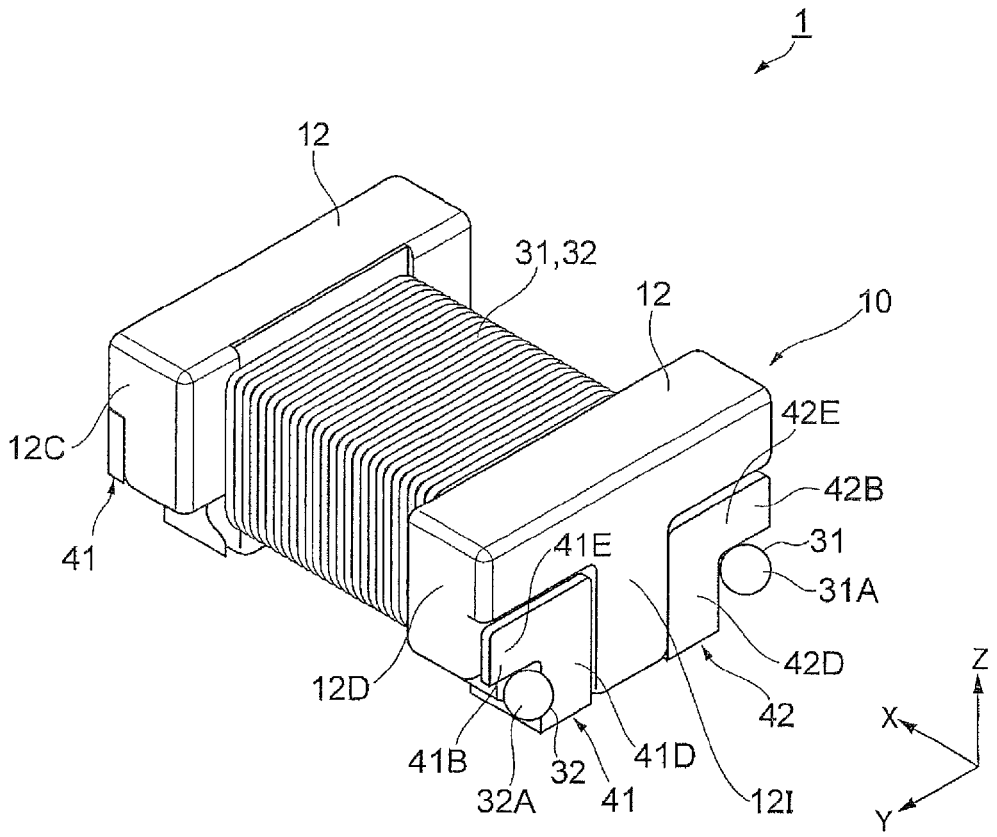
FIG. 1 is a schematic perspective view showing a coil component according to an embodiment of the present invention.

Hereinafter, an example embodiment of the present invention will be described in detail with reference to the accompanying drawings. Further, in the description, the same elements or elements having the same function are designated by the same reference numerals and overlapping description thereof will be omitted.

A coil component 1 according to the embodiment of the present invention will be described with reference to FIGS. 1 to 3. A coil component 1 is used as a vehicle-mounted common mode filter, which is to be reduced in size.

Figure 2:
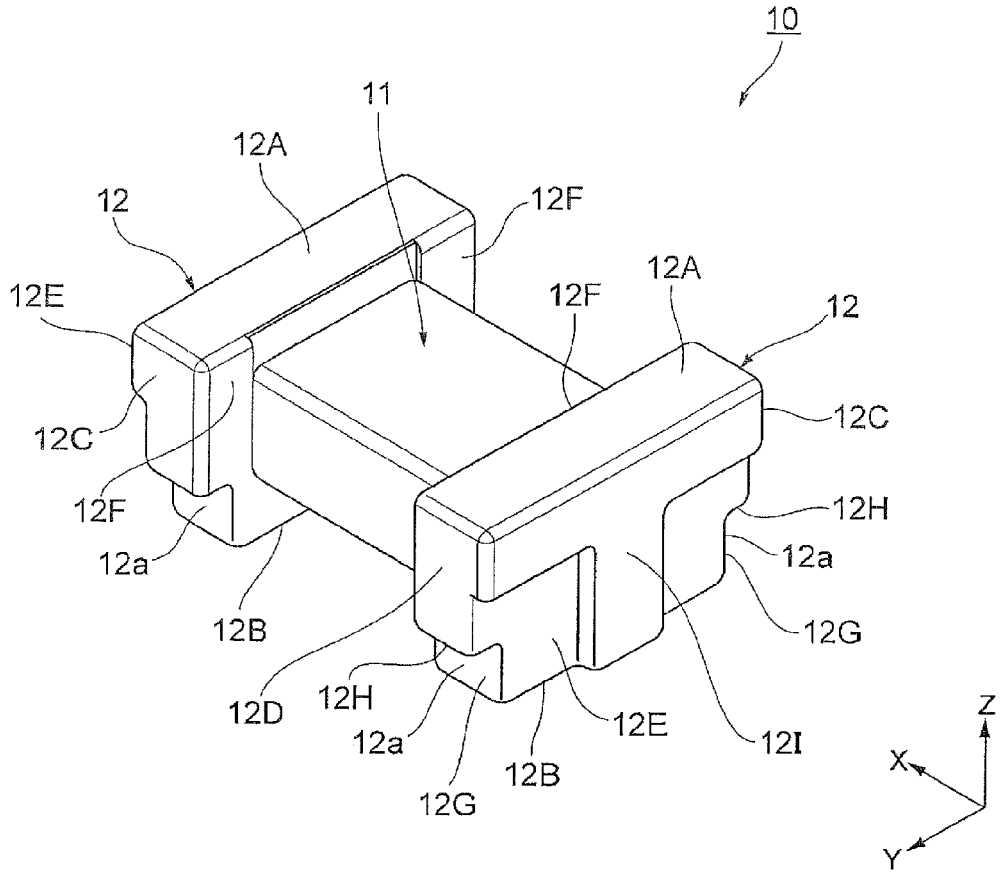
FIG. 2 is a schematic perspective view of a drum core of the coil component of FIG. 1 when seen from above.

As shown in FIGS. 1 and 2, the coil component 1 includes a drum core 10. As shown in FIG. 2, the drum core 10 has a core portion 11 having a substantially rectangular cross section perpendicular to a longitudinal direction thereof, and a pair of flange portions 12 and 12 formed at both ends in the longitudinal direction of the core portion 11 and having the same shape.

Two wires 31 and 32 are wound on the core portion 11. Since the flange portions 12 and 12 disposed at both ends of the drum core 10 have the same shape, hereinafter, only one flange portion 12 will be described unless the context clearly indicates otherwise. In addition, a longitudinal direction, which is a direction in which a shaft center of the core portion 11 is directed, is defined as an X-axis direction, a longitudinal direction of a substantially rectangular shape, which is a cross-sectional shape perpendicular to the longitudinal direction of the core portion 11, is defined as a Y-axis direction, and a direction perpendicular to the X-axis direction and the Y-axis direction is defined as a Z-axis direction. Further, a direction from a substantially lower right side toward a substantially upper left side of FIG. 1 is defined as a positive (+) X-axis direction, and an opposite direction thereof is defined as a negative (−) X-axis direction. In addition, a direction from a substantially upper right side toward a substantially lower left side of FIG. 1 is defined as a positive Y-axis direction, and an opposite direction thereof is defined as a negative Y-axis direction. In addition, a direction from a lower side toward an upper side of FIG. 1 is defined as a positive Z-axis direction, and an opposite direction thereof is defined as a negative Z-axis direction. A dimension of the drum core 10 in the X-axis direction is about 3.2 mm, a dimension of the drum core 10 in the Y-axis direction is about 2.5 mm, and a dimension of the drum core 10 in the Z-axis direction is about 1.5 mm.

The flange portions 12 and 12 are integrally formed with the core portion 11 at both ends of the core portion 11 in the X-axis direction. The flange portion 12 forms a substantially rectangular parallelepiped, which has six surfaces including an upper end face 12A, a mounting surface 12B, a first side surface 12C, a second side surface 12D, an outer end face 12E and an inner end face 12F. The upper end face 12A and the mounting surface 12B form a parallel positional relation and form a parallel positional relation with an XY plane. The first side surface 12C and the second side surface 12D form a parallel positional relation and form a parallel positional relation with an XZ plane. In addition, the outer end face 12E and the inner end face 12F form a parallel positional relation and form a parallel positional relation with a YZ plane.

Concave portions 12*a* are formed at both ends in the Y-axis direction of the mounting surface 12B. More specifically, the concave portion 12*a* is constituted by a notch portion, and from the outer end face 12E to the inner end face 12F, a joining portion of the first side surface 12C and the mounting surface 12B and a joining portion of the second side surface 12D and the mounting surface 12B configured to define an outer surface of a substantially rectangular parallelepiped form a cutout shape. That is, a cross-section cut at a surface perpendicular to the axial direction of the core portion 11 forms a shape in which angles of both ends of one side of the rectangular shape corresponding to the mounting surface 12B of the flange portion 12 having a substantially rectangular shape are cut out. A portion that partitions the concave portion 12*a* at a portion of the flange portion 12 is constituted by a longitudinal wall 12G and a lateral wall 12H, the longitudinal wall 12G forms parallel positional relations with the first side surface 12C and the second side surface 12D, and the lateral wall 12H forms parallel positional relations with the upper end face 12A and the mounting surface 12B.

Figure 3:
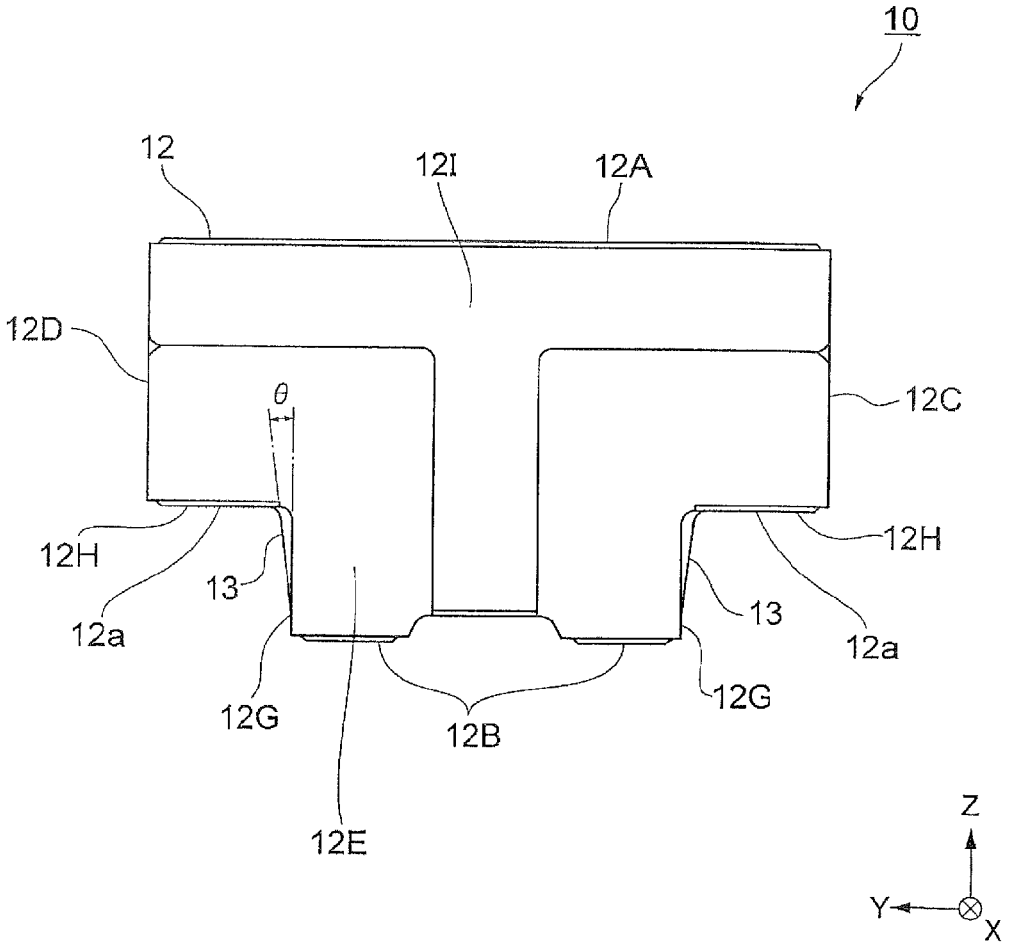
FIG. 3 is a view showing an end face of the drum core of FIG. 2.
Figure 4:
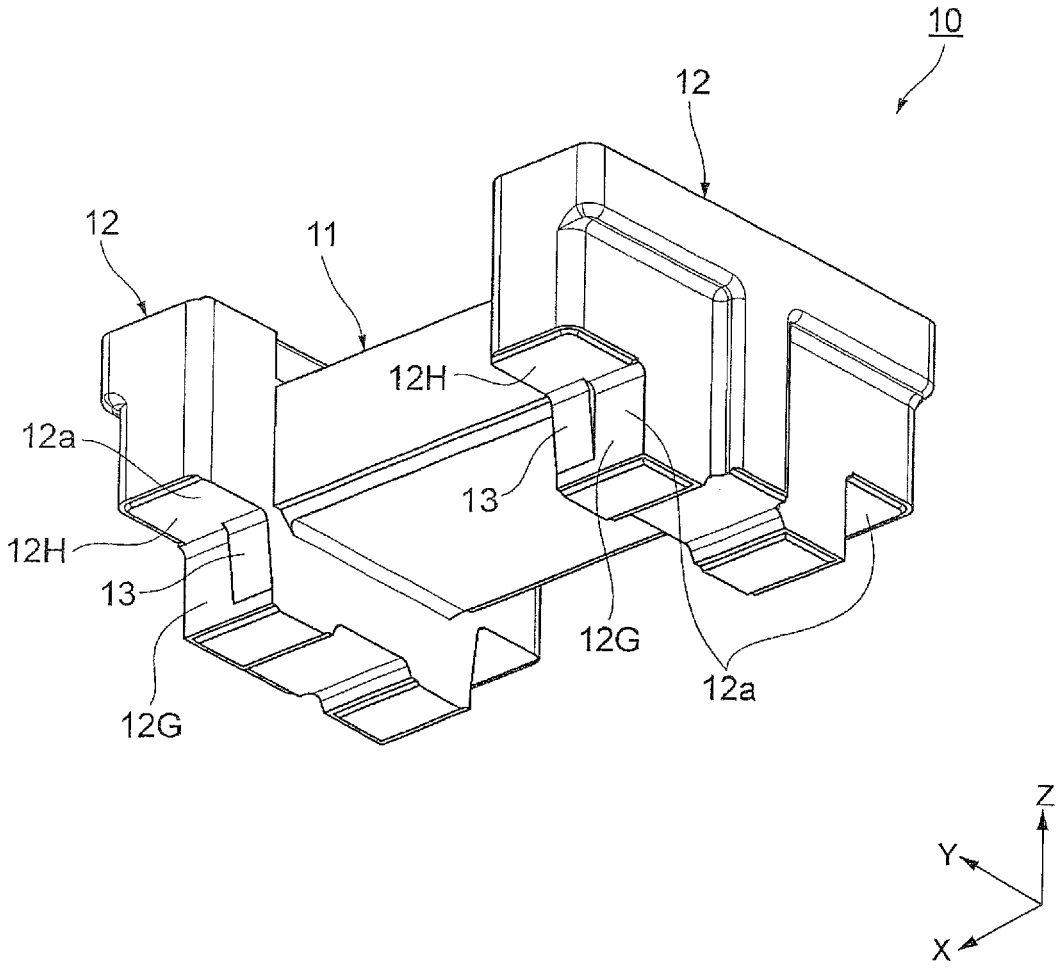
FIG. 4 is a schematic perspective view of a drum core of FIG. 2 when seen from below.

In addition, as shown in FIGS. 3 and 4, a convex portion 13 protruding from the longitudinal wall 12G is formed at each of the concave portions 12*a*. The convex portion 13 is formed at a region about halfway to the core portion 11 side in a surface of the longitudinal wall 12G and extends from a lower end to an upper end of the longitudinal wall 12G A formation region of the convex portion 13 corresponds to wire fixing portions 41C and 42C of metal terminals 41 and 42 (to be described below). In addition, the convex portion 13 is inclined with respect to the surface of the longitudinal wall 12G and more specifically, inclined such that a width thereof increases away from the mounting surface 12B (i.e., in the positive Z-axis direction).

An inclination angle of the convex portion 13 may be, for example, 2 to 20 degrees.

A T-shaped protrusion 121 is formed at the outer end face 12E of the flange portion 12. As shown in FIG. 2, the T-shaped protrusion 121 protrudes away from the core portion 11 in the X-axis direction, and a protrusion amount in the same direction is the same in the entire portion formed in a T shape. The protrusion amount is such an amount that a surface welded to the flange portion 12 is flush with an opposite surface at surfaces of end-face portions 41B and 42B of the metal terminals 41 and 42 (to be described below), or is an amount protruding away from the core portion 11 in the X-axis direction farther than the opposite surface.

The wires 31 and 32 are constituted by copper wires, which are coated with insulation, and are wound on the core portion 11 by so-called 2-layer winding in which the wire 31 is wound on the core portion 11 and then the wire 32 is wound thereon. The wires 31 and 32 are pulled from the vicinity of the joining portion connected to the flange portion 12 at the portion of the core portion 11 and extend toward the concave portion 12*a*. Each of one end and another end of both the wires 31 and 32 is disposed in the vicinity of one of the four concave portions 12*a*, and is electrically connected to the metal terminal 41 or 42 (to be described below) at a position opposite to the concave portion 12*a* in the X-axis direction in the vicinity of the concave portion 12*a*, forming wire connecting portions 31A and 32A. The wire connecting portions 31A and 32A constitutes welding balls with portions of the metal terminals 41 and 42 as each of the one end and another end of both the wires 31 and 32 is laser-welded to the metal terminal 41 or 42 (to be described below).

The metal terminals 41 and 42 are installed at each of the flange portions 12. The metal terminals 41 and 42 are disposed throughout the outer end face 12E and the mounting surface 12B of the flange portion 12. The metal terminal 41 and the metal terminal 42 are constituted by terminal metal fittings formed by cutting and bending one metal plate formed of phosphor bronze through punching. Accordingly, the metal terminal 41 and the metal terminal 42 become one metal plate when they return to a state before the bending. One surface of the metal terminal 41 and the metal terminal 42 is adhered to a mounting substrate (not shown), and plating of nickel and tin is performed on the one surface. In addition, the other surface facing the one surface is adhered to the flange portion 12, and the phosphor bronze is exposed to the other surface as it is. Since the metal terminal 41 and the metal terminal 42 form a mirror-symmetric shape, only the metal terminal 42 will be described and the metal terminal 41 will be omitted unless the context clearly indicates otherwise.

Figure 5A:
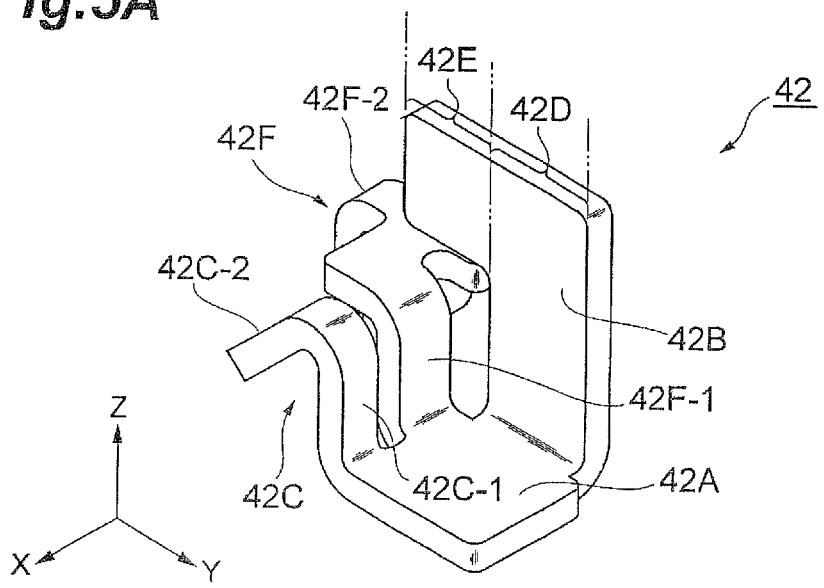
FIG. 5A is a perspective view showing a metal terminal of the coil component of FIG. 1.
Figure 5B:
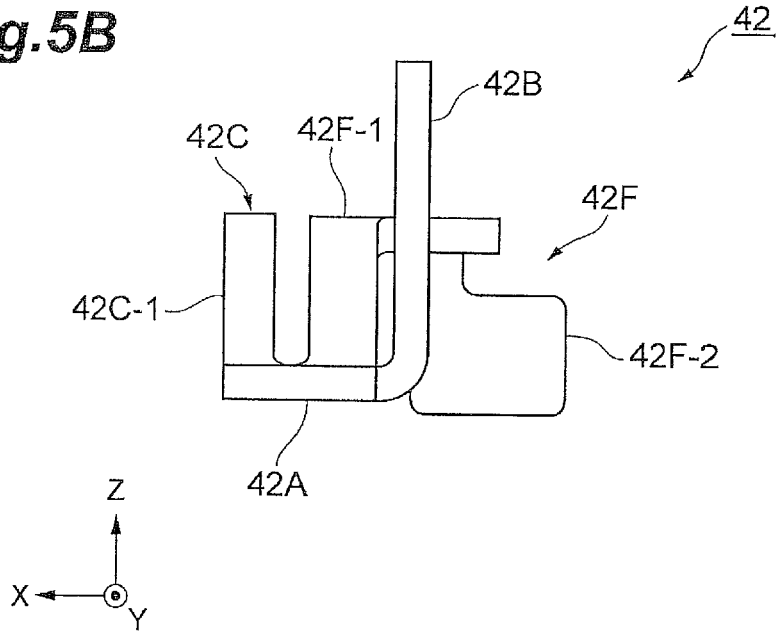
FIG. 5B is an end view in an X-Z plane showing the metal terminal of the coil component of FIG. 1.

As shown in FIGS. 5A and 5B, the metal terminals 41 and 42 have mounting portions 41A and 42A and the end-face portions 41B and 42B, each of which forms a plate shape. The mounting portions 41A and 42A form a substantially rectangular plate shape, and are disposed at an end in the positive Y-axis direction and an end in the negative Y-axis direction to be fixed to the flange portion 12 by an adhesive agent at a portion of the mounting surface 12B of the flange portion 12.

The end-face portion 42B is integrally formed with a portion of one side of the mounting portion 42A having a substantially rectangular shape, and forms a perpendicular positional relation with the mounting portion 42A. The end-face portion 42B has an end-face portion base portion 42D having a substantially rectangular shape in which a longitudinal direction is provided in the Z-axis direction, and an end-face portion extension portion 42E having a substantially rectangular shape extending from the end-face portion base portion 42D in the Y-axis direction. The end-face portion base portion 42D and the end-face portion extension portion 42E form substantially an inverted L shape, and as shown in FIG. 1, the end-face portion 42B is disposed to be welded to the outer end face 12E to surround the concave portion 12*a* on the outer end face 12E.

In the mounting portion 42A, a wire fixing portion 42C and an electrode wire connecting portion 42F are formed in parallel at a portion of one side of the mounting portion 42A having a substantially rectangular shape. The wire fixing portion 42C and the electrode wire connecting portion 42F are integrally formed with the mounting portion 42A. The wire fixing portion 42C and the electrode wire connecting portion 42F are constituted by bending pieces formed of portions of the terminal metal fitting that constitutes the metal terminal 42.

The bending piece of the wire fixing portion 42C is constituted by a portion 42C-1 extending from the mounting portion 42A into the concave portion 12*a* and extending in the positive Z-axis direction on the longitudinal wall 12G and a portion 42C-2 turned back from the extension end in substantially the negative Z-axis direction, and is accommodated in the concave portion 12*a*. The vicinity of the one end and the vicinity of the other end of the wire 31 are sandwiched and held by the portion extending in the positive Z-axis direction and the portion turned back in the negative Z-axis direction.

The bending piece of the electrode wire connecting portion 42F is constituted by a portion 42F-1 extending from the mounting portion 42A into the concave portion 12*a* and extending parallel to the portion 42C-1 of the wire fixing portion 42C at the end end-face portion 42B side of the wire fixing portion 42C, and a portion 42F-2 turned back from the extension end in substantially the negative Z-axis direction away from the core portion 11. The portion 42F-1 of the electrode wire connecting portion 42F is accommodated in the concave portion 12*a*, and the portion 42F-2 extends outward from the concave portion 12*a* in a direction of the X-axis. As shown in FIG. 5B, the portion 42F-2 of the electrode wire connecting portion 42F includes a portion having a rectangular flat plate shape perpendicular to the Y-axis, and the portion is bent toward the drum core 10 (a front side of the drawing) to be substantially parallel to the X-Y plane.

In the metal terminal 42, the wire 31 is disposed between the portion 42C-1 and the portion 42C-2 of the wire fixing portion 42C, and the wire 31 is sandwiched between the portion 42C-1 and the portion 42C-2 as the portion 42C-2 of the wire fixing portion 42C is bent to sandwich the wire 31 therebetween. Then, in the electrode wire connecting portion 42F, the wire 31 extends between the portion 42F-1 and the portion 42F-2, and the wire 31 comes in contact with the portion 42F-2 as the rectangular flat plate-shaped portion of the portion 42F-2 shown in FIG. 5B is bent. Further, in a state in which the wire 31 is in contact with the portion 42F-2, a laser is radiated in the Z-axis direction from below, and the wire 31 and the electrode wire connecting portion 42F are laser-welded. Further, in a similar way, the one end portions or the other end portions of the wires 31 and 32 are laser-welded to the electrode wire connecting portion 42F one by one, and electrically connected to form wire connections.

Figure 6A:
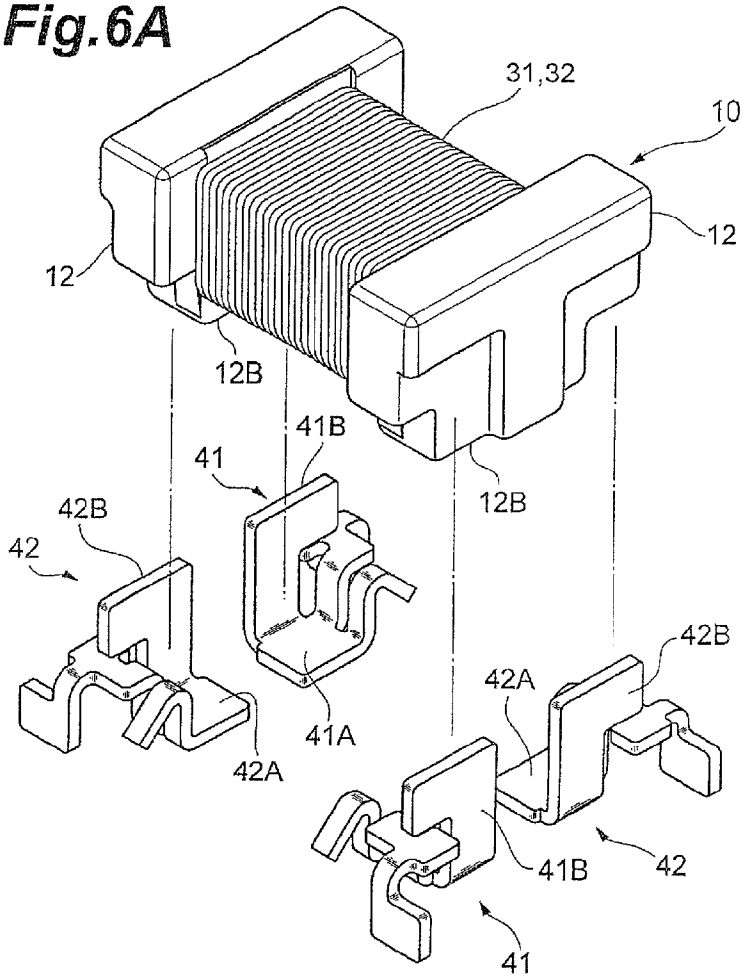
FIG. 6A is a view of an aspect of attaching the metal terminal of FIGS. 5A and 5B, showing a state before attachment.
Figure 6B:
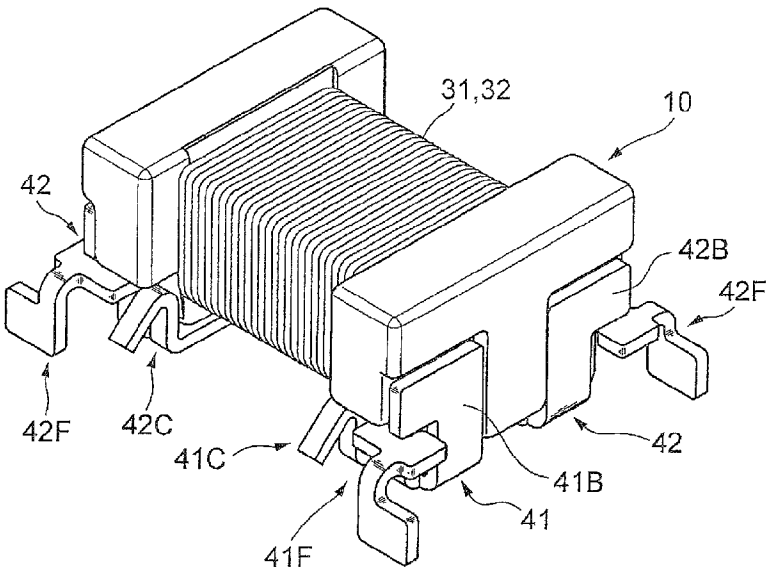
FIG. 6B is a view of an aspect of attaching the metal terminal of FIGS. 5A and 5B, showing a state after attachment.

The above-mentioned metal terminals 41 and 42 are attached to the drum core 10 in a state shown in FIGS. 6A and 6B.

That is, as shown in FIG. 6A, for example, the four metal terminals 41 and 42 relatively positioned by a predetermined tool or the like are prepared, and an adhesive agent (not shown) is applied to the mounting portions 41A and 42A of the metal terminals 41 and 42. Then, the drum core 10 is placed on the metal terminals 41 and 42 such that the mounting surface 12B of the flange portion 12 of the drum core 10 is supported by the mounting portions 41A and 42A of the metal terminals 41 and 42.

As a result, the entire wire fixing portions 41C and 42C of the metal terminals 41 and 42 and portions 41 F-1 and 42F-1 of electrode wire connecting portions 41F and 42F are accommodated in the concave portion 12*a* of the flange portion 12.

Figure 7A:
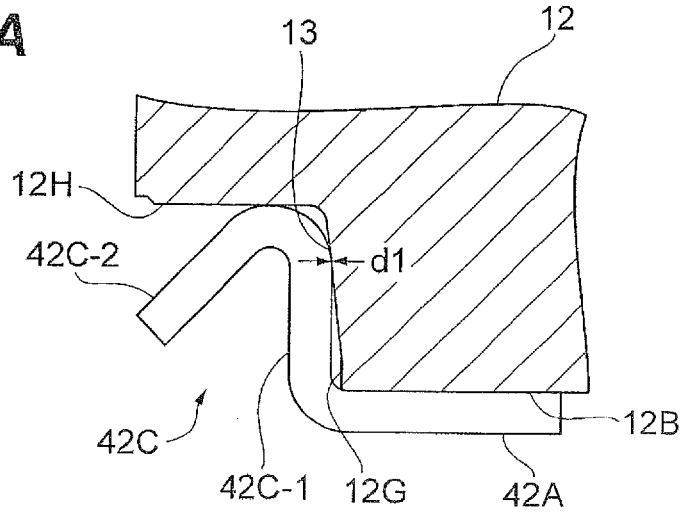
FIG. 7A is a view of an aspect of bending a wire fixing portion of the metal terminal of FIGS. 5A and 5B, showing a state before the bending.

Here, since the convex portion 13 is formed at the longitudinal wall 12G of a region of the concave portion 12*a* corresponding to the wire fixing portions 41C and 42C, as shown in FIG. 7A, for example, the portion 42C-1 of the wire fixing portion 42C comes in contact with or approaches the convex portion 13. When the shortest distance between the portion 42C-1 of the wire fixing portion 42C and the convex portion 13 is d1, d1 is 0 or a small value.

Figure 7B:
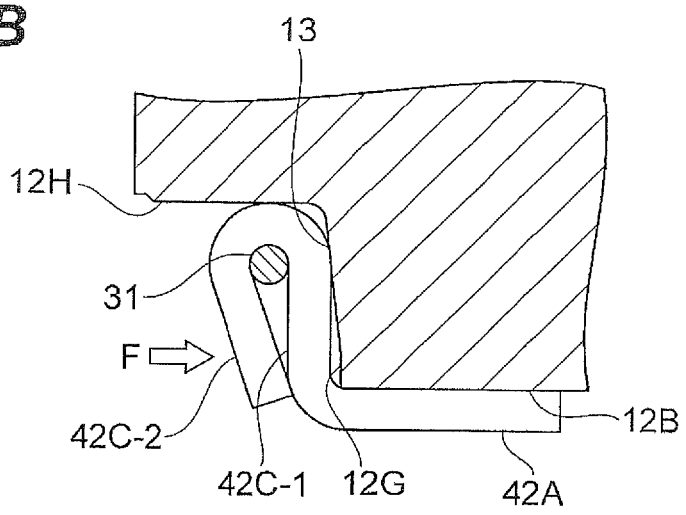
FIG. 7B is a view of an aspect of bending the wire fixing portion of the metal terminal of FIGS. 5A and 5B, showing a state after the bending.

For this reason, as shown in FIG. 7B, in order to sandwich the wire 31 disposed between the portion 42C-1 and the portion 42C-2 of the wire fixing portion 42C, when a force F in an arrow direction of the drawing is added and the portion 42C-2 of the wire fixing portion 42C is bent, the portion 42C-1 abuts the convex portion 13 of the longitudinal wall 12G As the portion 42C-1 abuts the convex portion 13 in this way, the bending force F is efficiently transmitted to the portion 42C-2, and the portion 42C-2 is sufficiently bent. Meanwhile, when the convex portion 13 is not formed, the shortest distance between the portion 42C-1 and the longitudinal wall 12G is increased, and the portion 42C-1 does not easily abut the longitudinal wall 12G Since the portion 42C-1 is elastically deformed in the gap between the portion 42C-1 and the longitudinal wall 12G and the bending force F is partially absorbed when they do not abut each other, transmission efficiency of the force is decreased.

That is, in the above-mentioned coil component 1, as the convex portion 13 is formed at the concave portion 12*a* of the flange portion 12 of the drum core 10, the wire 31 can be securely fixed by the wire fixing portion 42C.

Figure 8:
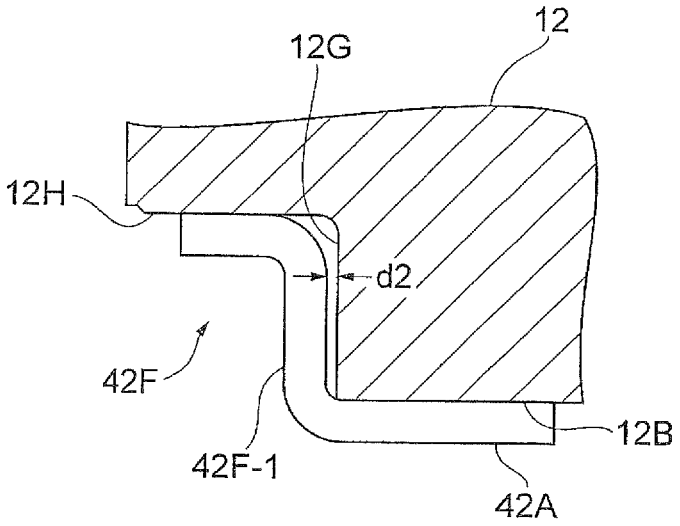
FIG. 8 is a view showing an attachment state of the wire connecting portion of the metal terminal of FIGS. 5A and 5B.

In relation with the electrode wire connecting portions 41F and 42F, as shown in FIG. 8, since the above-mentioned convex portion 13 is not formed at the longitudinal wall 12G of the corresponding region, the shortest distance d2 between the portion 42F-1 of the electrode wire connecting portion 42F and the convex portion 13 is larger than the shortest distance dl between the portion 42C-1 of the wire fixing portion 42C and the convex portion 13. Unlike the portion 42C-1 of the wire fixing portion 42C, the portion 42F-1 of the electrode wire connecting portion 42F may have a certain gap with respect to the longitudinal wall 12G This is because, while the wire 31 is laser-welded to the portion 42F-2 after the portion 42F-2 of the electrode wire connecting portion 42F is bent toward the drum core 10, when a position of the wire 31 is varied with respect to the electrode wire connecting portion 42F before the laser welding, it is impossible to perform stable wire connecting (welding).

As described above, in the coil component 1, the shortest distance d1 from the longitudinal wall 12G to the wire fixing portions 41C and 42C is smaller than the shortest distance d2 from the longitudinal wall 12G of the flange portion 12 of the drum core 10 to the electrode wire connecting portions 41F and 42F by the convex portion 13 formed at the longitudinal wall 12G of the flange portion 12. That is, since the gap between the flange portion 12 of the drum core 10 and the wire fixing portions 41C and 42C is small (or there is no gap), the wire fixing portions 41C and 42C can be sufficiently bent.

Accordingly, in the above-mentioned coil component 1, the wires 31 and 32 can be more securely fixed by the wire fixing portions 41C and 42C of the metal terminals 41 and 42.

In addition, the convex portion 13 is inclined such that a width thereof increases away from the mounting surface 12B of the flange portion 12. For this reason, as the convex portion 13 goes away from the mounting surface 12B, the gap between the longitudinal wall 12G of the flange portion 12 of the drum core 10 and the wire fixing portions 41C and 42C reduces. In many cases, since bending of the wire fixing portions 41C and 42C is performed at a position spaced apart from the mounting surface 12B, in this case, the conducting wire can be more securely fixed. Moreover, since the width of the convex portion 13 is reduced at the mounting surface 12B, as shown in FIGS. 6A and 6B, when the drum core 10 is inserted and disposed between the metal terminals 41 and 42, the insertion and fixing can be easily performed without interference with the convex portion 13.

In addition, while the one end portions and the other end portions of the wires 31 and 32 are electrically connected to the metal terminals 41 and 42 by the laser welding to form the wire connections, the method of electrical connection and wire connection is not limited thereto, and for example, arc welding may be used.

In addition, while the wires 31 and 32 are wound on the core portion 11 through the so-called 2-layer winding in which the wire 31 is wound on the core portion 11 and then the wire 32 is wound thereon, the winding method is not limited thereto. For example, a winding method of simultaneously winding two wires on the core portion 11 in parallel may be used.

Further, while the aspect in which the convex portion is formed at the region corresponding to the wire fixing portion has been shown, the region corresponding to the wire fixing portion may relatively protrude with respect to the region corresponding to the wire connecting portion, and for this reason, the region corresponding to the wire connecting portion may be concaved with respect to the region corresponding to the wire fixing portion (the aspect in which the concave portion is formed).

What is claimed is:

1. A coil component comprising:

a drum core having a pair of flange portions having a mounting surface enabling to face to a mounting substrate and side surfaces crossing the mounting surface, and a core portion configured to connect the pair of flange portions to each other;

a wire wound on the core portion of the drum core; and a metal terminal having a mounting portion disposed at the mounting surface of first flange portion of the pair of flange portions, a wire fixing portion configured to fix the wire and extending from the mounting portion, and a wire connecting portion welded to an end of the wire, the wire fixing portion and the wire connecting portion being located on a same side with respect to the first flange portion, wherein a shortest distance from the side surface of the first flange portion to the wire fixing portion is smaller than a shortest distance from the side surface of the first flange portion to the wire connecting portion wherein the wire fixing portion includes a planar surface;

the wire connecting portion includes a planar surface;

the planar surface of the wire fixing portion and the planar surface of the wire connecting portion are parallel and side by side with each other and face the side surface of the first flange portion; and a shortest distance from the side surface of the first flange portion to the planar surface of the wire fixing portion is smaller than a shortest distance from the side surface of the first flange portion to the planar surface of the wire connecting portion.

2. The coil component according to claim 1, wherein a convex portion is formed at a surface region corresponding to the wire fixing portion of the side surfaces of the first flange portion.

3. The coil component according to claim 2, wherein the convex portion is inclined such that a width of the convex increases away from the mounting surface.

4. The coil component according to claim 1, wherein the core portion elongates between the pair of flange portions in a longitudinal direction, and the metal terminal further comprises an end face portion, the wire connecting portion being located between the end-face portion and the wire fixing portion in the longitudinal direction.

* * * * *